US006959933B1

(12) United States Patent
Roth

(10) Patent No.: US 6,959,933 B1
(45) Date of Patent: Nov. 1, 2005

(54) TWIN LINE SKATES

(76) Inventor: Edmund H. Roth, 6310 SW. 4th Pl., Margate, FL (US) 33068

( * ) Notice: Subject to any disclaimer, the term of this patent is extended or adjusted under 35 U.S.C. 154(b) by 132 days.

(21) Appl. No.: 10/430,130

(22) Filed: May 6, 2003

(51) Int. Cl.[7] ..... A63C 17/04

(52) U.S. Cl. ..... 280/11.25; 280/11.27; 280/11.19

(58) Field of Search ..... 280/11.19, 11.204, 280/11.207, 11.208, 11.223, 11.25, 11.27, 280/11.3; 301/5.23, 5.7, 5.301, 5.305

(56) References Cited

U.S. PATENT DOCUMENTS

| | | | | | |
|---|---|---|---|---|---|
| 327,350 | A | * | 9/1885 | Terherst | 301/5.7 |
| 341,186 | A | * | 5/1886 | Tilden | 280/11.208 |
| 577,628 | A | | 2/1897 | Segerberg | |
| 824,108 | A | | 6/1906 | Fulton | |
| 864,622 | A | | 8/1907 | Domis | |
| 979,795 | A | * | 12/1910 | Pfautz | 280/11.19 |
| 1,751,934 | A | | 3/1930 | Linton et al. | |
| 3,602,941 | A | * | 9/1971 | Lewin | 16/21 |
| 3,693,988 | A | * | 9/1972 | Steinhiser | 280/11.223 |
| 4,310,168 | A | * | 1/1982 | Macaluso | 280/11.25 |
| 4,541,643 | A | | 9/1985 | Pavincic | |
| 4,709,937 | A | | 12/1987 | Lin et al. | |
| 5,393,078 | A | * | 2/1995 | Bourdeau | 280/11.225 |
| 5,456,477 | A | * | 10/1995 | Bourdeau | 301/5.7 |
| 5,720,529 | A | * | 2/1998 | Barron | 301/5.23 |
| 6,454,361 | B1 | * | 9/2002 | Martin | 301/5.301 |
| 2002/0105152 | A1 | * | 8/2002 | Miller | 280/11.231 |
| 2003/0020244 | A1 | * | 1/2003 | Sung | 280/11.19 |

* cited by examiner

*Primary Examiner*—Frank Vanaman
(74) *Attorney, Agent, or Firm*—Oltman, Flynn & Kubler

(57) ABSTRACT

A wheeled skate includes a shoe cradle for receiving a user shoe, the shoe cradle having opposing first and second shoe cradle sides; a wheel mounting structure; a wheel mounting structure elevation mechanism interconnecting the shoe cradle and the wheel mounting structure including for selectively elevating and lowering the shoe cradle relative to the wheel mounting structure; and an annular wheel rotatably mounted around the wheel mounting structure.

4 Claims, 4 Drawing Sheets

124a
124a
124
126
26
72a
72
74
76
80
78
80a
22
120

124a
148
126
120

10
124a
130
146
148
140
130
24
126
74
126a
72
22
120
124

132
140
148
B
120
126
24
126a
B 132
140
124
124a

TWIN LINE SKATES

BACKGROUND OF THE INVENTION

1. Field of the Invention

The present invention relates generally to the field of sporting and entertainment vehicles such as skates. More specifically the present invention relates to a set of wheeled skates, each skate including a shoe cradle for receiving a user shoe and a shoe harness for fastening around and releasibly securing a user shoe into the shoe cradle, a wheel mounting disk secured to each side of the shoe cradle with a disk elevation mechanism for selectively elevating and lowering shoe cradle relative to the corresponding wheel mounting disk, an annular wheel rotatably mounted around the wheel mounting disk and retained by and riding on bearings within a bearing raceway located between the wheel mounting disk circumferential surface and the annular wheel inward surface, the bearing raceway containing several ball or roller bearings.

The shoe cradle preferably includes a cradle bottom wall having a bottom wall forward end, a bottom wall rearward end and two opposing and spaced apart bottom wall sides, each bottom wall side being integral with an upright cradle side wall. A brake pad arm protrudes rearwardly and angles downwardly from the cradle bottom wall rearward end, terminating in a substantially horizontal and planar arm contact end fitted with a replaceable brake pad.

Each disk elevation mechanism preferably includes an outwardly opening vertical drive screw guide slot in each of the cradle side walls, and a drive screw guide flange extending from the center of each wheel mounting disk into the adjacent guide slot, such that the drive screw guide flange is slidable upwardly and downwardly within the drive screw guide slot, each guide flange having a vertical and internally threaded drive screw bore, and a drive screw passageway extending upwardly from the bottom of each cradle side wall directly below and opening upwardly into the corresponding guide slot, and a drive screw extending vertically upwardly through and into and threadedly engaging the drive screw bore in the guide flange. interior or with an adhesive.

2. Description of the Prior Art

There have long been shoe mounted wheeled skates, well known as roller skates. Some roller skates have had two wheels, one on each side, and some have had four wheels, two on each side, mounted on narrow and bendable axles. What has been lacking is a skate with wheels attached to the shoe cradle with solid, sturdy broad contact. Also lacking has been independent wheel elevating means for selectively elevating and lowering individual wheels relative to the shoe cradle.

Segerberg, U.S. Pat. No. 577,628, issued on Feb. 23, 1897, discloses a roller skate having two opposing and independently mounted wheels which are angled to converge and abut each other at their lower ends and having squeeze bulb activated brakes. The Segerberg wheels ride on narrow, bearing mounted axles.

Domis, U.S. Pat. No. 864,622, issued on Aug. 27, 1907, teaches a roller skate having a shoe cradle plate with shoe securing straps and having two wheels, one mounted on each side of the shoe cradle plate on independent axles extending into axle ports in brackets secured to the upper surface of the cradle plate. The wheels are mounted in staggered relation with the intention of permitting the user to more easily execute certain turns.

Fulton, U.S. Pat. No. 824,108, issued on Jun. 26, 1908, reveals a roller skate having a shoe cradle and two wheels mounted on opposing sides of the cradle and a wheel axle secured across the cradle. The wheel axle has an axle middle segment with a square cross section and has axle end segments with round cross sections, two intermediate bars secured to the axle by means of U-shaped screw clamps and being curled upwardly so that they do not catch on the ground.

Nanz, U.S. Pat. No. 1,751,942, issued on Mar. 25, 1930, discloses a roller skate. Nanz includes a frame having a fixed foot rest and a pair of freely rotatable traction wheels of unequal size mounted on opposite sides of the frame. The larger wheel is journaled above the foot rest while the smaller wheel is journaled below the foot rest.

Pavincle, U.S. Pat. No. 4,541,643, issued on Sep. 17, 1985, teaches skating device. The Pavincle skate has two wheels, each wheel being over four inches in diameter and capable of turning a corner by merely shifting the weight of the skater body so as to apply a turning force upon either the inside or outside wheel of each skate relative to the opposite wheel. Pavincle includes a frame constructed to accommodate the foot of a skater, a first and second wheel, a wheel assembly for rotationally mounting the first and second wheels on opposite sides of the frame, the wheel assembly including a narrow wheel axle for each wheel, ball bearings mounted on each axle and unidirectional needle bearings for each wheel to permit rotation of the first and second wheel in only one direction, and suspension means for pivotally coupling each wheel axle to the frame. Each suspension means has a suspension pivot axis which is offset from each wheel axle so that each wheel axle is displaced relative to the suspension axis to cause the skate to turn based upon the distribution of the weight of the foot on the frame.

Lin, et al., U.S. Pat. No. 4,709,937, issued on Dec. 1, 1987, discloses a two-wheeled combination roller skate-ski. Lin, et al., includes a flat substantially rectangular base with four sides, two opposing sides being longitudinal sides, two other opposing sides being transverse sides, safety foot straps attached to the base for retaining a player foot on the base, and a pair of wheels disposed respectively outwardly of two opposing sides of the base such that intersections of a plane in which the base lies and two circles defined by the wheels constitute respective chords of the circles.

It is thus an object of the present invention to provide a wheeled skate having a shoe cradle and wheels attached to the shoe cradle with solid, sturdy broad contact.

It is another object of the present invention to provide such a wheeled skate having annular wheels mounted on wheel mounting disks fixedly secured to opposing sides of the shoe cradle.

It is still another object of the present invention to provide such a wheeled skate having independent wheel elevating means for selectively elevating and lowering individual wheels relative to the shoe cradle.

It is finally an object of the present invention to provide such a wheeled skate which is sturdy, highly maneuverable and relatively inexpensive to manufacture.

SUMMARY OF THE INVENTION

The present invention accomplishes the above-stated objectives, as well as others, as may be determined by a fair reading and interpretation of the entire specification.

A wheeled skate is provided, including a shoe cradle for receiving a user shoe, the shoe cradle having opposing first and second shoe cradle sides; a wheel mounting structure; a wheel mounting structure elevation mechanism interconnecting the shoe cradle and the wheel mounting structure including for selectively elevating and lowering the shoe cradle relative to the wheel mounting structure; and an annular wheel rotatably mounted around the wheel mounting structure.

The skate preferably additionally includes a bearing raceway extending circumferentially between the wheel mounting structure and the annular wheel and a plurality of bearings retained within the bearing raceway, the annular wheel riding on the bearings. The bearings preferably are one of: ball bearings and roller bearings. The skate preferably additionally includes a shoe harness connected to the shoe cradle for releasibly securing a user shoe into the shoe cradle.

The shoe cradle preferably includes a cradle bottom wall having a cradle bottom wall forward end, a cradle bottom wall rearward end and two opposing and spaced apart cradle bottom wall sides; and a cradle side wall extending upwardly from each of the cradle bottom wall sides. The shoe cradle preferably still further includes a brake pad; and a brake pad arm protruding downwardly from the cradle bottom wall rearward end, terminating in an arm contact end fitted with the brake pad.

The wheel mounting structure elevation mechanism preferably includes an outwardly opening vertical drive screw guide slot in at least one of the cradle side walls; a drive screw guide flange extending from the wheel mounting structure into the drive screw guide slot, so that the drive screw guide flange is slidable upwardly and downwardly within the drive screw guide slot, the guide flange having a vertical and internally threaded drive screw bore, and a drive screw passageway extending upwardly from the bottom of the given the cradle side wall directly below and opening upwardly into the drive screw guide slot;

and a drive screw having a drive screw head and extending upwardly through and into and threadedly engaging threads within the drive screw bore in the drive screw guide flange and extending to and bearing against the guide slot upper end, where the drive screw is accessible for engagement and rotation; so that rotating the drive screw in one rotational direction about its longitudinal axis advances the drive screw downwardly and away from the guide slot upper end, permitting the guide slot upper end to drop down against the drive screw guide flange and thus permit the wheel mounting disk to rise relative to the cradle, and rotating the given drive screw in the opposite rotational direction advances the drive screw upwardly and driveably against the guide slot upper end, driving the guide slot upper end upwardly relative to the drive screw guide flange and thus causing the wheel mounting disk to be lowered relative to the cradle.

The annular wheel preferably includes an annular rim portion having a rim portion lateral end opposite the cradle, the annular rim portion being joined to a lateral wheel wall portion extending across the rim portion lateral end. The annular rim portion preferably includes an outer circumferential surface, and the outer circumferential surface preferably includes a circumferential bead for making point contact with a planar skating surface.

The bearing raceway preferably includes a circumferential internal channel within the annular wheel; and a circumferential recess in the outer corner of the wheel structure. The bearing raceway preferably further includes a bearing passing port in the lateral wheel wall portion opening into the bearing raceway, the bearing passing port being sized to pass one of the bearings into the bearing raceway; and a port plug fitted into and secured within the bearing passing port. The port plug preferably is secured within the bearing passing port with mutually engaging screw threads on the port plug and within the bearing passing port. The port plug alternatively is secured within the bearing passing port with an adhesive between the port plug and the port.

A wheeled skate is further provided, including a shoe cradle for receiving a user shoe; a wheel mounting disk connected to the shoe cradle; and an annular wheel rotatably mounted around the wheel mounting disk. A wheeled skate is still further provided, including a shoe cradle for receiving a user shoe, the shoe cradle having opposing first and second shoe cradle sides; a first wheel mounting disk connected to the shoe cradle first side; a second wheel mounting disk connected to the shoe cradle second side; a first annular wheel rotatably mounted around the first wheel mounting disk; and a second annular wheel rotatably mounted around the second wheel mounting disk.

A wheeled skate is yet further provided, including a shoe cradle for receiving a user shoe, the shoe cradle having opposing first and second shoe cradle sides; a first wheel mounting disk and a second wheel mounting disk; a first disk elevation mechanism interconnecting the shoe cradle first side and the first wheel mounting disk for selectively elevating and lowering the shoe cradle first side relative to the first wheel mounting disk; a second disk elevation mechanism interconnecting the shoe cradle second side and the second wheel mounting disk for selectively elevating and lowering the shoe cradle second side relative to the second wheel mounting disk; a first annular wheel rotatably mounted around the first wheel mounting disk; and a second annular wheel rotatably mounted around the second wheel mounting disk.

A wheeled skate is yet additionally provided, including a shoe cradle for receiving a user shoe; a wheel mounting structure connected to the shoe cradle; an annular wheel rotatably mounted around the wheel mounting structure; and a wheel mounting structure elevation mechanism interconnecting the shoe cradle and the wheel mounting structure for selectively elevating and lowering the shoe cradle relative to the wheel mounting structure.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
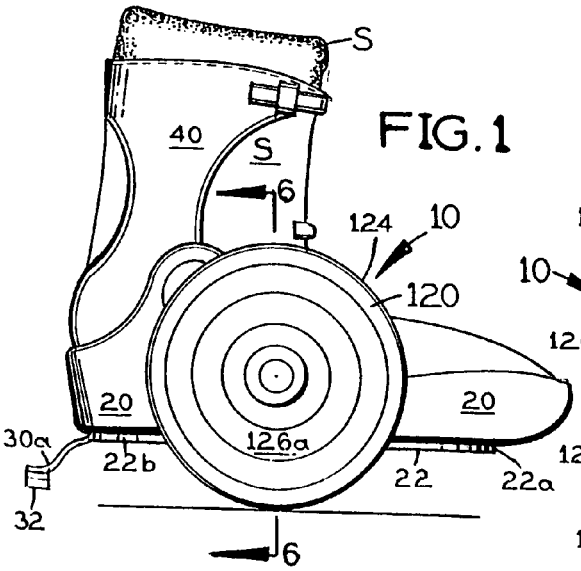
FIG. 1 is a side view of the preferred embodiment of the inventive wheeled skate.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Figure 2:
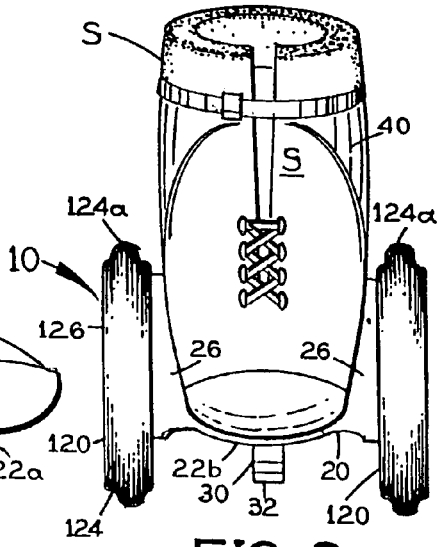
FIG. 2 is a front view of the skate of FIG. 1.
Figure 3:
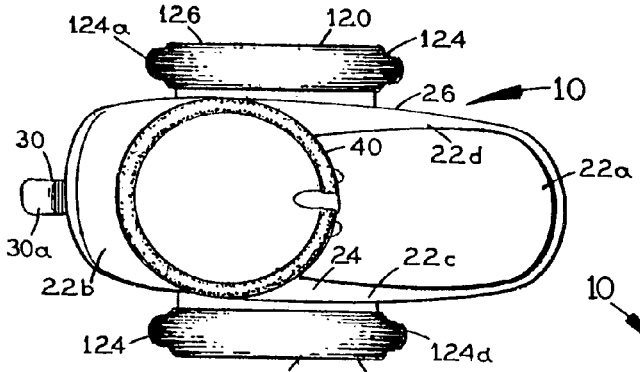
FIG. 3 is a top view of the skate of FIG. 1.
Figure 4:
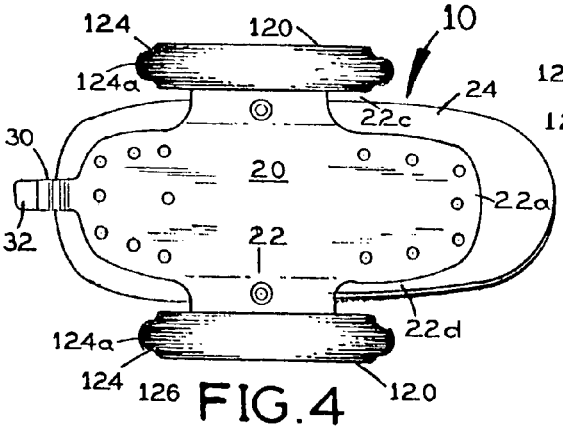
FIG. 4 is a bottom view of the skate of FIG. 1.
Figure 5:
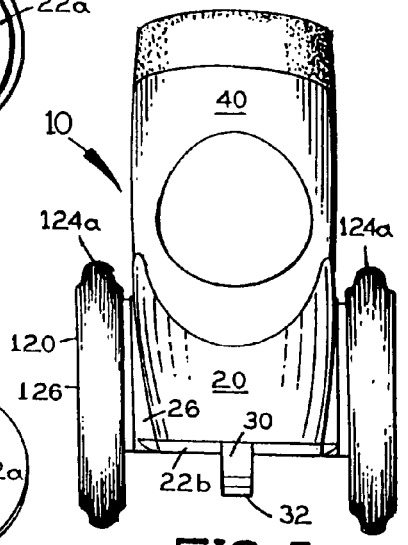
FIG. 5 is a front view of the skate of FIG. 1.
Figure 6:
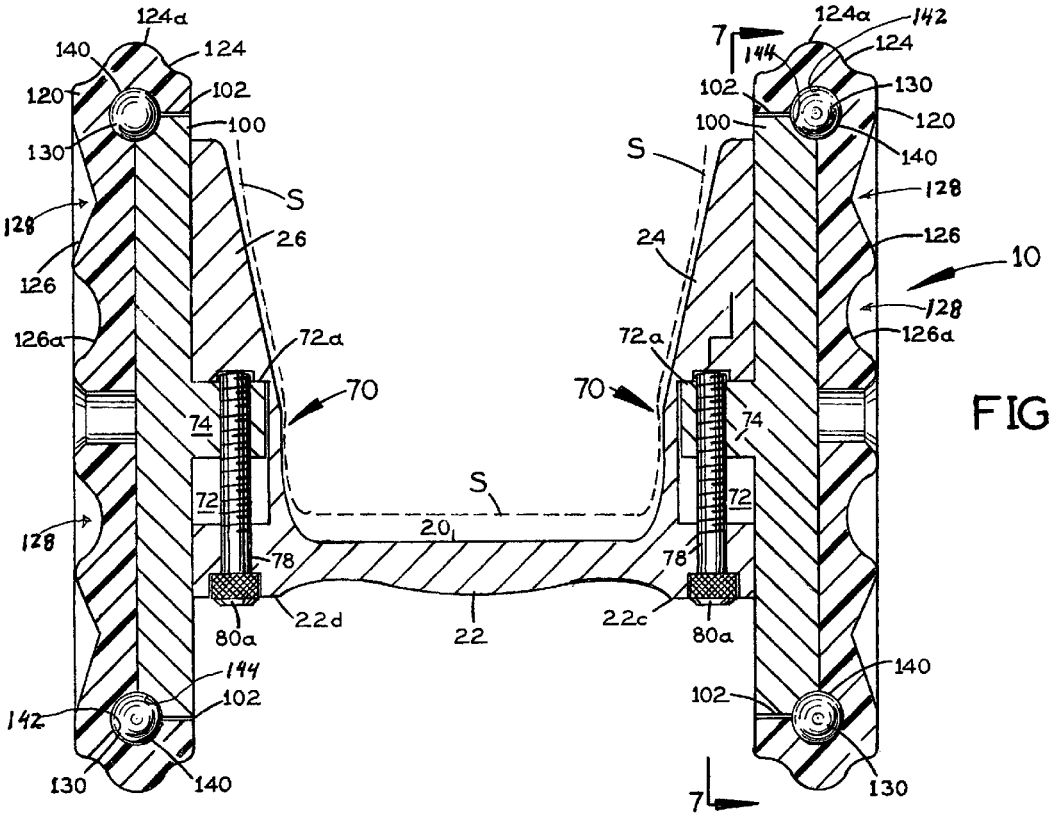
FIG. 6 is a cross-sectional rear view of the skate of FIG. 1, with the shoe shown in broken lines.
Figure 7:
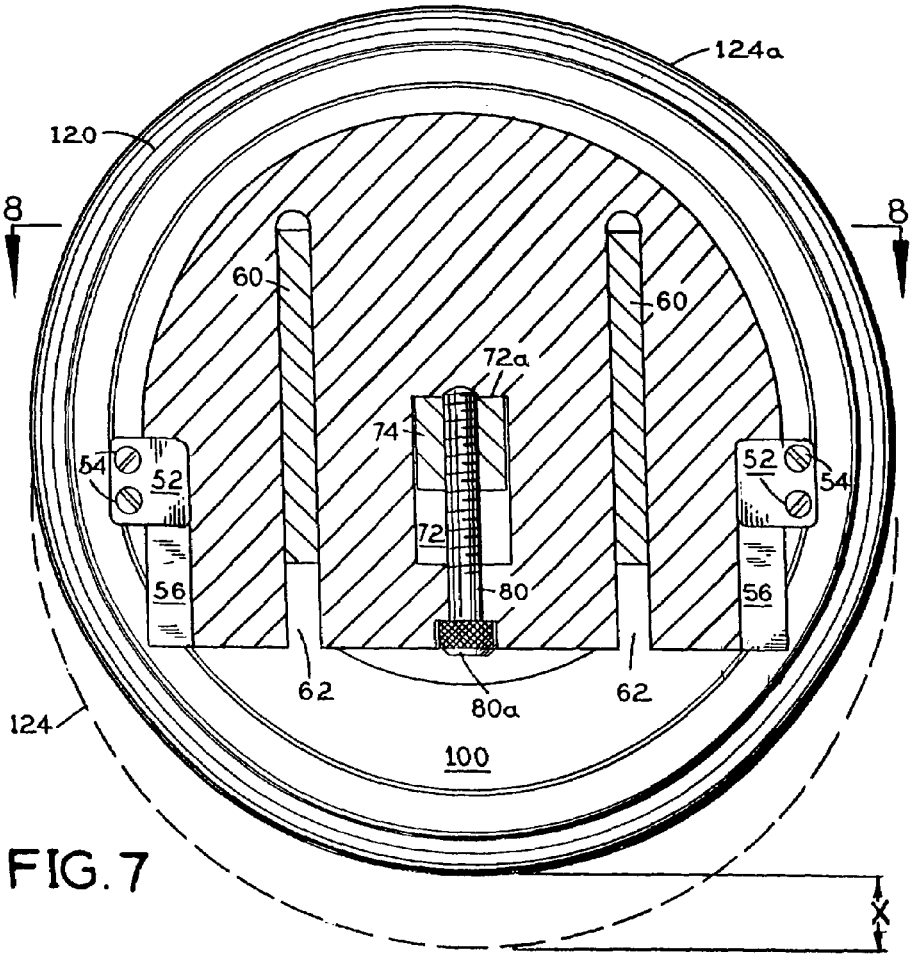
FIG. 7 is a cross-sectional view taken along line 7—7 of FIG. 6, showing the disk elevation mechanism and optional strengthening guide flanges and guide tabs, and showing the wheel in an elevated position in solid lines and in a prior, lower position in broken lines, the elevation distance marked as "x".
Figure 8:
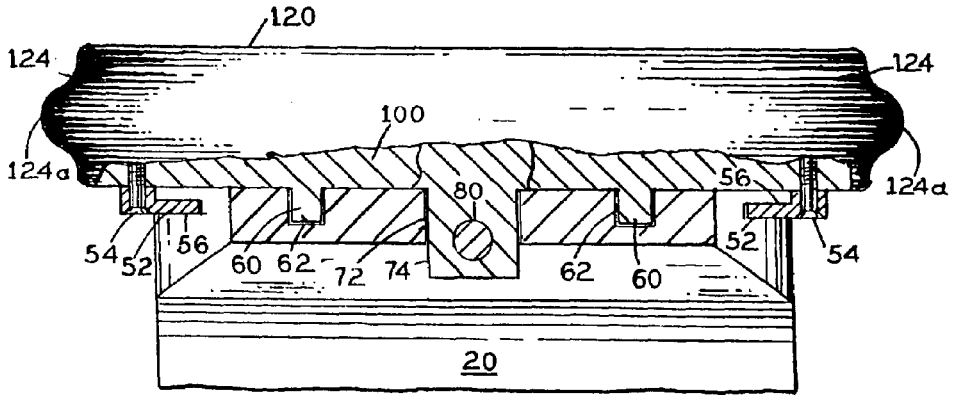
FIG. 8 is a cross-sectional top view taken along line 8—8 of FIG. 7, showing details of the guide flanges and guide tabs.
Figures 9, 10, 11, 12:
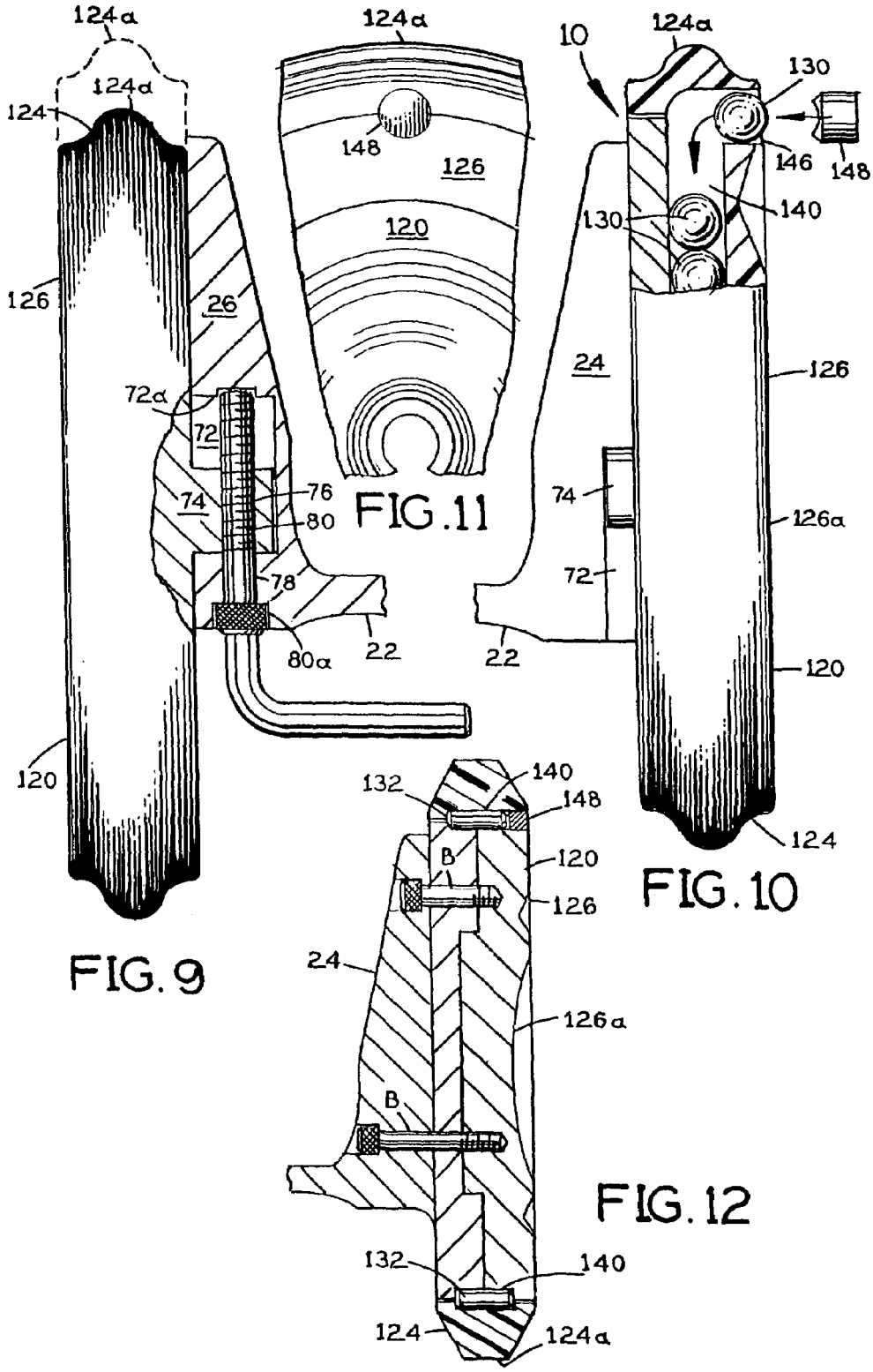
FIG. 9 is a partial broken away view of one side of the skate, showing the drive screw engaged by an Allen wrench, and showing the displacement of the wheel with broken lines indicated the position from which the wheel was moved by rotating the drive screw.
FIG. 10 is a partial broken away view of one side of the skate, showing the bearing raceway and ball bearings in the raceway and bearing passing port opening into the bearing raceway and port plug positioned for insertion into the bearing passing port.
FIG. 11 is a broken away section of a wheel showing the bearing passing port.
FIG. 12 is partial cross-sectional end view of one side of the skate showing the alternative roller bearings in the raceway, this skate replacing the disk elevating mechanism with bolts B fixedly connecting the shoe cradle to the wheel mounting disk.

Referring to FIGS. 1–12, a pair of wheeled skates is disclosed, each skate 10 including a shoe cradle 20 for receiving a user shoe S and the shoe harness, 40 for fastening around and releasibly securing a user shoe S into the shoe cradle 20, a wheel mounting disk 100 secured to each side of the shoe cradle 20 with a disk elevation mechanism 70 for selectively elevating and lowering the shoe cradle 20 relative to the corresponding wheel mounting disk 100, an annular wheel 120 rotatably mounted around the wheel mounting disk 100 and retained by and riding on bearings 130 rollably contained within a bearing raceway 140 located between the wheel mounting disk circumferential surface 102 and the annular wheel inside surface 122, the bearing raceway 140 containing several ball bearings 130 or roller bearings 132.

The shoe cradle 20 preferably includes a cradle bottom wall 22 having a bottom wall forward end 22*a*, a bottom wall rearward end 22*b* and two opposing and spaced apart first and second bottom wall sides 22*c* and 22*d*, bottom wall sides 22*c* and 22*d* each being integral with a corresponding upright first cradle side wall 24 and second cradle side wall 26, respectively. A brake pad arm 30 protrudes rearwardly and angles downwardly from the cradle bottom wall rearward end 22*b*, terminating in a substantially horizontal and planar arm contact end 30*a* fitted with a replaceable brake pad 32.

Each disk elevation mechanism 70 preferably includes a vertical drive screw guide slot 72 opening laterally outwardly from each of the first and second cradle side walls 24 and 26 and a drive screw guide flange 74 extending from the center of each wheel mounting disk 100 into the adjacent drive screw guide slot 72, such that the drive screw guide flange 74 is slidable upwardly and downwardly within its drive screw guide slot 72, each drive screw guide flange 74 having a vertical and internally threaded drive screw bore 76, and a drive screw passageway 78 extending upwardly from the bottom of each first and second cradle side wall 24 and 26, directly below and opening upwardly into the corresponding guide slot 72, and a drive screw 80 extending vertically upwardly through the drive screw passageway 78 and into and threadedly engaging the drive screw bore 76 in the given guide flange 74. See FIG. 6. The head 80*a* of the drive screw 80 is exposed and accessible from underneath the shoe cradle 20 and preferably is configured to be engaged and rotated by an Allen wrench.

Rotating one of the drive screws 80 in one rotational direction about its longitudinal axis advances the screw 80 downwardly and away from the guide slot upper end 72*a*, permitting the slot upper end to drop down against the drive screw guide flange 74 and thus permit the wheel mounting disk 100 to rise relative to the cradle 20, and rotating the given drive screw 80 in the opposite rotational direction advances the screw 80 upwardly and driveably against the guide slot upper end 72*a*, driving the slot upper end 72*a* upwardly relative to the drive screw guide flange 74 and thus causing the wheel mounting disk 100 to be lowered relative to the cradle 20. Unless the user wishes to laterally incline the cradle 20, both drive screws 80 are rotated in the same direction the same number of turns to raise or lower the cradle 20 relative to the wheels 120, to remain level relative to the ground.

To additionally strengthen and guide vertical movement of the wheels 120 relative to the cradle 20, a pair of spaced apart metal guide tabs 52 are fastened to and spaced from the wheel mounting disk 100, preferably with two guide tab screws 54, and extend generally parallel to the wheel mounting disk 100 toward each other and are slidably fitted into substantially vertical guide tab slots 56 in the forward and rearward ends of each of the cradle side walls 24 and 26. To yet further strengthen and guide vertical movement of the cradle 20, a pair of guide fins 60 preferably extend from the wheel mounting disk 100 slidably into guide fin slots 62 opening into the outward surfaces cradle side walls 24 and 26.

Each annular wheel 120 preferably includes an annular rim portion 124 integrally joined to a lateral wheel wall portion 126 extending across the lateral end of the annular rim portion 124 which optionally includes decorative recesses 128, such as concentric circles, in its exterior lateral face 126*a*. The outer circumferential surface of the annular rim portion 124 preferably includes a central circumferential bead 124*a* for making point contact with a skating surface such as the ground.

The bearing raceway 140 preferably includes a circumferential internal channel 142 in the annular rim portion 124 inward surface extending into the wheel wall portion 126 and a circumferential recess 144 in the outer corner of the given wheel disk 100. A bearing passing port 146 is provided in the lateral wheel wall portion 126 directly adjacent and opening into the bearing raceway 140. See FIG. 10. The bearing passing port 146 is sized to pass bearings such as ball bearings 130, preferably one at a time, into the raceway 140 during skate 10 manufacture and assembly. Then the bearing passing port 146 is closed with a port plug 148 fitted into the port 146 and secured, such as with mutually engaging screw threads on the plug 148 exterior and the port 146 interior or with an adhesive. The plug 148 preferably is removable from the port 146 and replaceable.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A wheeled skate, comprising:

a shoe cradle for receiving a user shoe, said shoe cradle having opposing first and second shoe cradle sides;

a wheel mounting structure;

a wheel mounting structure elevation mechanism interconnecting said shoe cradle and said wheel mounting structure comprising means for selectively elevating and lowering said shoe cradle relative to said wheel mounting structure;

and an annular wheel rotatable mounted around said wheel mounting structure;

said wheel mounting structure elevation mechanism comprising:

an outwardly opening vertical drive screw guide slot in at least one of said cradle side walls;

a drive screw guide flange extending from said wheel mounting structure into said drive screw guide slot, such that said drive screw guide flange is slidable upwardly and downwardly within said drive screw guide slot, said guide flange having a vertical and internally threaded drive screw bore, and a drive screw passageway extending upwardly from the bottom of the given said cradle side wall directly below and opening upwardly into said drive screw guide slot;

and a drive screw having a drive screw head and extending upwardly through and into and threadedly engaging threads within said drive screw bore in said drive screw guide flange and extending to and bearing against said guide slot upper end, wherein said drive screw is accessible for engagement and rotation;

such that rotating said drive screw in one rotational direction about its longitudinal axis advances said drive screw downwardly and away from said guide slot upper end, permitting said guide slot upper end to drop down against said drive screw guide flange and thus permit said wheel mounting structure to rise relative to said cradle, and rotating the given said drive screw in the opposite rotational direction advances said drive screw upwardly and driveably against said guide slot upper end, driving said guide slot upper end upwardly relative to said drive screw guide flange and thus causing said wheel mounting structure to be lowered relative to said cradle.

2. A wheeled skate, comprising:

a shoe cradle for receiving a user shoe, said shoe cradle having opposing first and second shoe cradle sides;

a wheel mounting structure;

a wheel mounting structure elevation mechanism interconnecting said shoe cradle and said wheel mounting structure comprising means for selectively elevating and lowering said shoe cradle relative to said wheel mounting structure;

an annular wheel rotatable mounted around said wheel mounting structure, said annular wheel comprising an annular rim portion having a rim portion lateral end opposite said cradle, said annular rim portion being joined to a lateral wheel wall portion extending across the rim portion lateral end;

a bearing raceway extending circumferentially between said wheel mounting structure and said annular wheel and a plurality of bearings retained within said bearing raceway, said annular wheel riding on said bearings;

a bearing passing port in said lateral wheel wall portion opening into said bearing raceway, said bearing passing port being sized to pass one of said bearings into said bearing raceway;

and a port plug fitted into and secured within said bearing passing port.

3. The skate of claim 2, wherein said port plug is secured within said bearing passing port with mutually engaging screw threads on said port plug and within said bearing passing port.

4. The skate of claim 2, wherein said port plug is secured within said bearing passing port with an adhesive between said port plug and said bearing passing port.

* * * * *